US008974193B2

(12) United States Patent
Li et al.

(10) Patent No.: US 8,974,193 B2
(45) Date of Patent: Mar. 10, 2015

(54) SYNTHETIC JET EQUIPMENT

(71) Applicant: Industrial Technology Research Institute, Hsinchu (TW)

(72) Inventors: Chien Li, Tainan (TW); Chung-De Chen, Miaoli County (TW); Pin Chang, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 350 days.

(21) Appl. No.: 13/655,381

(22) Filed: Oct. 18, 2012

(65) Prior Publication Data

US 2013/0323099 A1 Dec. 5, 2013

(30) Foreign Application Priority Data

May 31, 2012 (TW) ..... 101119481 A

(51) Int. Cl.
*F04B 39/06* (2006.01)
*F04B 39/08* (2006.01)
*F04B 45/047* (2006.01)

(52) U.S. Cl.
CPC ..... *F04B 39/08* (2013.01); *F04B 45/047* (2013.01)
USPC ..... 417/413.1; 165/80.3; 417/322

(58) Field of Classification Search
CPC .... F04B 45/043; F04B 45/045; F04B 45/047; F04B 45/053; F04B 43/025; F04B 43/028
USPC ..... 417/413.1, 322, 413.2, 413.3, 479, 490, 417/505; 165/80.3, 121; 92/49, 96
See application file for complete search history.

(56) References Cited

U.S. PATENT DOCUMENTS 3,955,901 A * 5/1976 Hamilton ..... 417/395
4,086,036 A * 4/1978 Hagen et al. ..... 417/413.1
5,011,379 A * 4/1991 Hashimoto ..... 417/360
5,525,041 A 6/1996 Deak (Continued)

FOREIGN PATENT DOCUMENTS

TW I307764 3/2009
TW I328735 8/2010

(Continued)

OTHER PUBLICATIONS

Ryan Holman et al., "Formation Criterion for Synthetic Jets," AIAA Journal, Oct. 2005, pp. 2110-2116, vol. 43, No. 10, American Institute of Aeronautics and Astronautics, Inc. US.

(Continued)

*Primary Examiner* — Devon Kramer
*Assistant Examiner* — Kai-Ti Chang

(57) ABSTRACT

A synthetic jet equipment is provided, including a base, a frame fixed to the base, a first member, a pump diaphragm, a second member, and a valve diaphragm. The pump diaphragm connects the first member to the frame, and the valve diaphragm connects the second member to the frame. The base, the frame, the first member, the pump diaphragm, the second member, and the valve diaphragm define a chamber forming an intake and an outlet. When the first member moves in a first direction, the second member moves in a second direction opposite to the first direction and the external air flows into the chamber through the inlet. When the first member moves in the second direction, the second member moves in the first direction, such that the air is exhausted from the chamber through the outlet.

13 Claims, 5 Drawing Sheets

(56) References Cited

U.S. PATENT DOCUMENTS

| | | | | |
|---|---|---|---|---|
| 5,542,821 | A * | 8/1996 | Dugan | 417/53 |
| 5,758,823 | A | 6/1998 | Glezer et al. | |
| 5,861,703 | A | 1/1999 | Losinski | |
| 5,894,990 | A | 4/1999 | Glezer et al. | |
| 5,982,801 | A | 11/1999 | Deak | |
| 6,056,204 | A | 5/2000 | Glezer et al. | |
| 6,123,145 | A | 9/2000 | Glezer et al. | |
| 6,457,654 | B1 | 10/2002 | Glezer et al. | |
| 6,588,497 | B1 | 7/2003 | Glezer et al. | |
| 6,722,581 | B2 | 4/2004 | Saddoughi | |
| 6,759,159 | B1 | 7/2004 | Gray et al. | |
| 7,336,486 | B2 | 2/2008 | Mongia | |
| 7,527,086 | B2 | 5/2009 | Wang et al. | |
| 7,550,034 | B2 | 6/2009 | Janse Van Rensburg et al. | |
| 7,550,901 | B2 | 6/2009 | Chrysler et al. | |
| 7,553,135 | B2 | 6/2009 | Cho et al. | |
| 7,607,470 | B2 | 10/2009 | Glezer et al. | |
| 7,682,137 | B2 | 3/2010 | Nakayama | |
| 7,688,583 | B1 | 3/2010 | Arik et al. | |
| 7,793,709 | B2 | 9/2010 | Mukasa et al. | |
| 7,841,843 | B2 | 11/2010 | Cho et al. | |
| 7,932,535 | B2 | 4/2011 | Mahalingam et al. | |
| 7,939,991 | B2 | 5/2011 | Yamada et al. | |
| 7,972,124 | B2 | 7/2011 | Hirata et al. | |
| 7,984,751 | B2 | 7/2011 | Wang et al. | |
| 7,990,705 | B2 | 8/2011 | Bult et al. | |
| 8,066,410 | B2 | 11/2011 | Booth et al. | |
| 2003/0002995 | A1 * | 1/2003 | Urano et al. | 417/322 |
| 2006/0147329 | A1 * | 7/2006 | Tanner | 417/505 |
| 2007/0181709 | A1 | 8/2007 | Lee | |
| 2008/0240942 | A1 * | 10/2008 | Heinrich et al. | 417/322 |
| 2009/0084866 | A1 | 4/2009 | Grimm et al. | |
| 2009/0311116 | A1 * | 12/2009 | Bai et al. | 417/413.2 |
| 2010/0104458 | A1 * | 4/2010 | Grapes | 417/395 |
| 2010/0110630 | A1 | 5/2010 | Arik et al. | |
| 2011/0120679 | A1 | 5/2011 | Tanaka | |
| 2011/0122571 | A1 | 5/2011 | Artman et al. | |
| 2011/0168361 | A1 | 7/2011 | Chao et al. | |
| 2012/0181360 | A1 * | 7/2012 | Darbin et al. | 239/589 |

FOREIGN PATENT DOCUMENTS

| | | |
|---|---|---|
| TW | M395114 | 12/2010 |
| TW | I336829 | 2/2011 |
| TW | I342364 | 5/2011 |
| TW | 201128374 | 8/2011 |

OTHER PUBLICATIONS

Clemens J.M. Lasance et al., "Synthetic Jet Cooling Part II: Experimental Results of an Acoustic Dipole Cooler," 24$^{th}$ IEEE SEMI-THERM Symposium, Mar. 2008, pp. 26-31, IEEE, US.

Raghav Mahalingam et al., "Thermal Management Using Synthetic Jet Ejectors," IEEE Transactions of Components and Packaging Technologies, Sep. 2004, pp. 439-444, vol. 27, No. 3, IEEE, US.

Anna Pavlova et al., "Electronic Cooling Using Synthetic Jet Impingement," Journal of Heat Transfer, Sep. 2006, pp. 897-907, vol. 128, ASME, US.

Barton L. Smith et al., "The formation and Evolution of Synthetic Jets," Physics of Fluids, Sep. 1998, pp. 2281-2297, American Institute of Physics, US.

* cited by examiner

SYNTHETIC JET EQUIPMENT

CROSS REFERENCE TO RELATED APPLICATIONS

This application claims priority of Taiwan Patent Application No. 101119481, filed on May 31, 2012, the entirety of which is incorporated by reference herein in its entirety.

TECHNICAL FIELD

The disclosure relates to synthetic jet equipment, and relates to heat dissipation in synthetic jet equipment.

BACKGROUND

The synthetic jet can provide turbulent flow for heat dissipation, which has better convectional efficiency when compared to a laminar flow. The conventional synthetic jet actuator comprises a chamber, a diaphragm, and an outlet. When the diaphragm moves upward and compresses the chamber during vibration, air is ejected through the outlet from the chamber and forms the synthetic jet. When the diaphragm moves downward, air is drawn into the chamber. With repeated vibrations, the actuator can eject incontinuous synthetic jet. However, since the outlet of the conventional synthetic jet actuator is also usually used as an intake, the ejected air may be drawn back into the chamber, such that the heat transfer efficiency may be hampered.

Additionally, the conventional synthetic jet actuator may be combined with a cooler (such as fins), to form a heat dissipation mechanism. Though conventional synthetic jet actuators can eject air to dissipate heat via fins, some of the heated air will be drawn back into the chamber, thus, causing temperatures inside of the chamber to rise, thus, decreasing heat dissipation efficiency.

SUMMARY

The disclosure provides a synthetic jet equipment, comprising a base, a frame fixed to the base, a first member, a pump diaphragm, a second member, and a valve diaphragm. The pump diaphragm connects the first member to the frame, and the valve diaphragm connects the second member to the frame. The base, the frame, the first member, the pump diaphragm, the second member, and the valve diaphragm define a chamber forming an intake and an outlet. When the first member moves in a first direction, the second member moves in a second direction opposite to the first direction, and the external air flows into the chamber through the inlet. When the first member moves in the second direction, the second member moves in the first direction, such that the air is exhausted from the chamber through the outlet A detailed description is given in the following embodiments with reference to the accompanying drawings.

BRIEF DESCRIPTION OF THE DRAWINGS

The disclosure can be more fully understood by reading the subsequent detailed description and examples with references made to the accompanying drawings, wherein.

DETAILED DESCRIPTION OF THE DISCLOSURE

Figure 1:
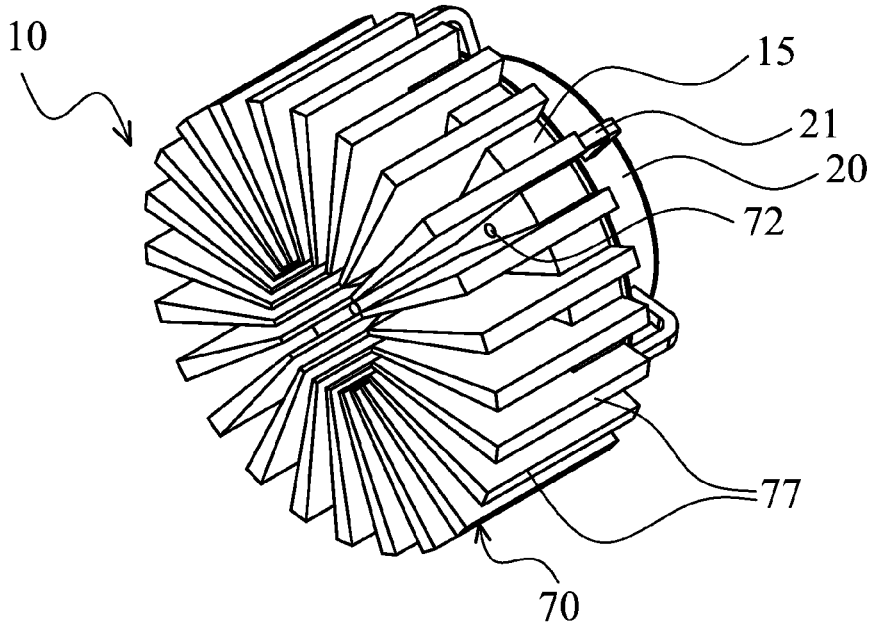
FIG. 1 is a perspective diagram showing a synthetic jet equipment according to an embodiment of the disclosure.
Figure 2:
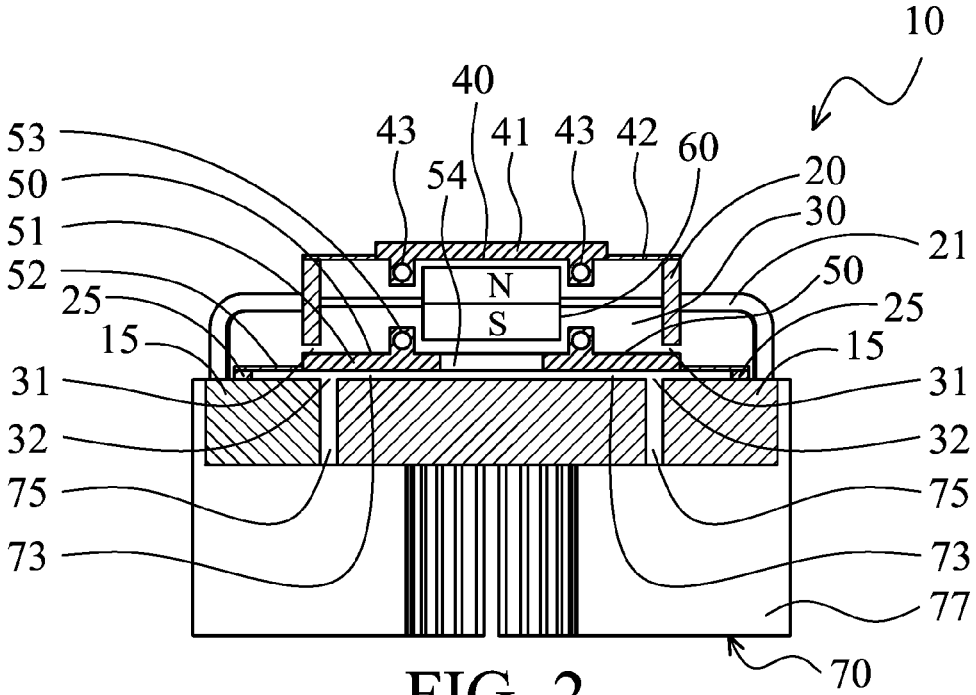
FIG. 2 is a sectional view of a synthetic jet equipment according to an embodiment of the disclosure.
Figure 5:
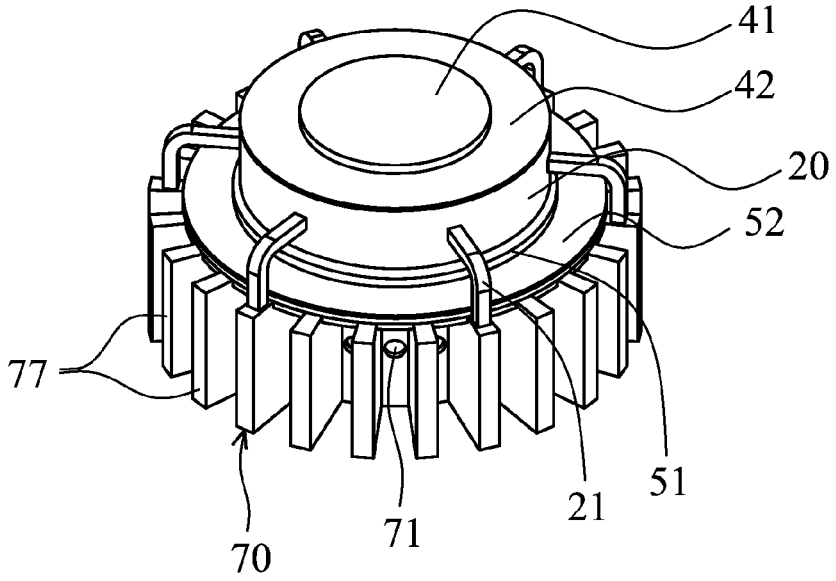
FIG. 5 is a perspective diagram showing a synthetic jet equipment according to another embodiment of the disclosure.

Referring to FIG. 1 and FIG. 2, an embodiment of the disclosure provides a synthetic jet equipment 10 comprising a base 15, a frame 20, a holder 21, a first member 41, a pump diaphragm 42, a second member 51, a valve diaphragm 52, a magnetic unit 60, and a heat exchanger 70. As shown in FIG. 1 and FIG. 2, the heat exchanger 70 is disposed below the base 15, and the second member 51, the frame 20, the magnetic unit 60 in the frame 20, and the first member 41 are disposed above the base 15. A fixed member 25 is disposed on the base 15, and the valve diaphragm 52 connects the fixed member 25 to an edge of the second member 51. The frame 20, the second member 51, and the base 15 are separated from each other and between a bottom edge of the frame 20 and the second member 51, the base 15 form a gap for drawing air into the frame 20. The holder 21 is fixed to the heat exchanger 70 (as shown in FIG. 1 and FIG. 5) and extended through the frame 20 to fix the magnetic unit 60 in the frame 20. Thus, the magnetic unit 60 can be positioned between the first member 41 and the second member 51. In some embodiments, the magnetic unit 60 may be a permanent magnet with N and S poles.

As shown in FIG. 2, the pump diaphragm 42 surrounds the first member 41 and connects the first member 41 with an upper edge of the frame 20. A first coil 43 is disposed in the first member 41 and surrounds an edge of the magnetic unit 60, such as the edge of the N pole. The first coil 43 may be disposed on a first surface 40 of the first member 41. In some embodiments, the first coil 43 and the first member 41 may be integrally formed in one piece. A through hole 54 is formed at the center of the second member 51, and the valve diaphragm 52 connects the second member 51 to the fixed member 25. A second coil 53 is disposed in the second member 51 and surrounds an edge of the magnetic unit 60, such as the edge of the S pole. The second coil 53 may be disposed on a second surface 50 of the second member 51. In some embodiments, the second coil 53 and the second member 51 may be integrally formed in one piece. The wires extended from the first coil 43 and the second coil 53 can be guided along the holder 21 to an external power source.

The frame 20, the first member 41, the second member 51, the pump diaphragm 42, and the valve diaphragm 52 define a chamber 30 therebetween, wherein an intake 31 is formed between the frame 20 and the second member 51, and an outlet 32 is formed on the base 15. A first flow channel 73 is formed between the base 15 and the second member 51 to communicate the through hole 54 to the outlet 32.

As shown in FIG. 1 and FIG. 2, the heat exchanger 70 connects to the base 15 and forms a plurality of fins 77 surrounding the base 15. The heat exchanger 70 is positioned under the base 15. The base 15 has a circular structure, wherein the fins 77 are radically disposed under the base 15.

The fins 77 are equidistant annularity arrangement. During usage, the bottom of the heat exchanger 70 may connect to a heat source, such as an LED, and the heat can be dissipated by the fins 77 surrounding the heat exchanger 70. In some embodiments, the base 15 and the heat exchanger 70 may be integrally formed in one piece.

The mechanism of the magnetic unit 60, the first member 41, the first coil 43, the second member 51, and the second coil 53 in FIG. 3 will be described below. When an alternating current is applied to the first coil 43 and the second coil 53, the magnetic field caused by the current can influence the magnetic unit 60 by a magnetic force (Lorentz force) upward or downward. When the current direction of the first coil 43 is as shown in FIG. 3, the first coil 43 and the magnetic unit 60 produce a repulsion force (first magnetic force) therebetween, such that the pump diaphragm 42 and the first member 41 move in a first direction A1, and air is drawn into the chamber 30 through the intake 31, as the arrow S1 indicates in FIG. 3.

Figure 3:
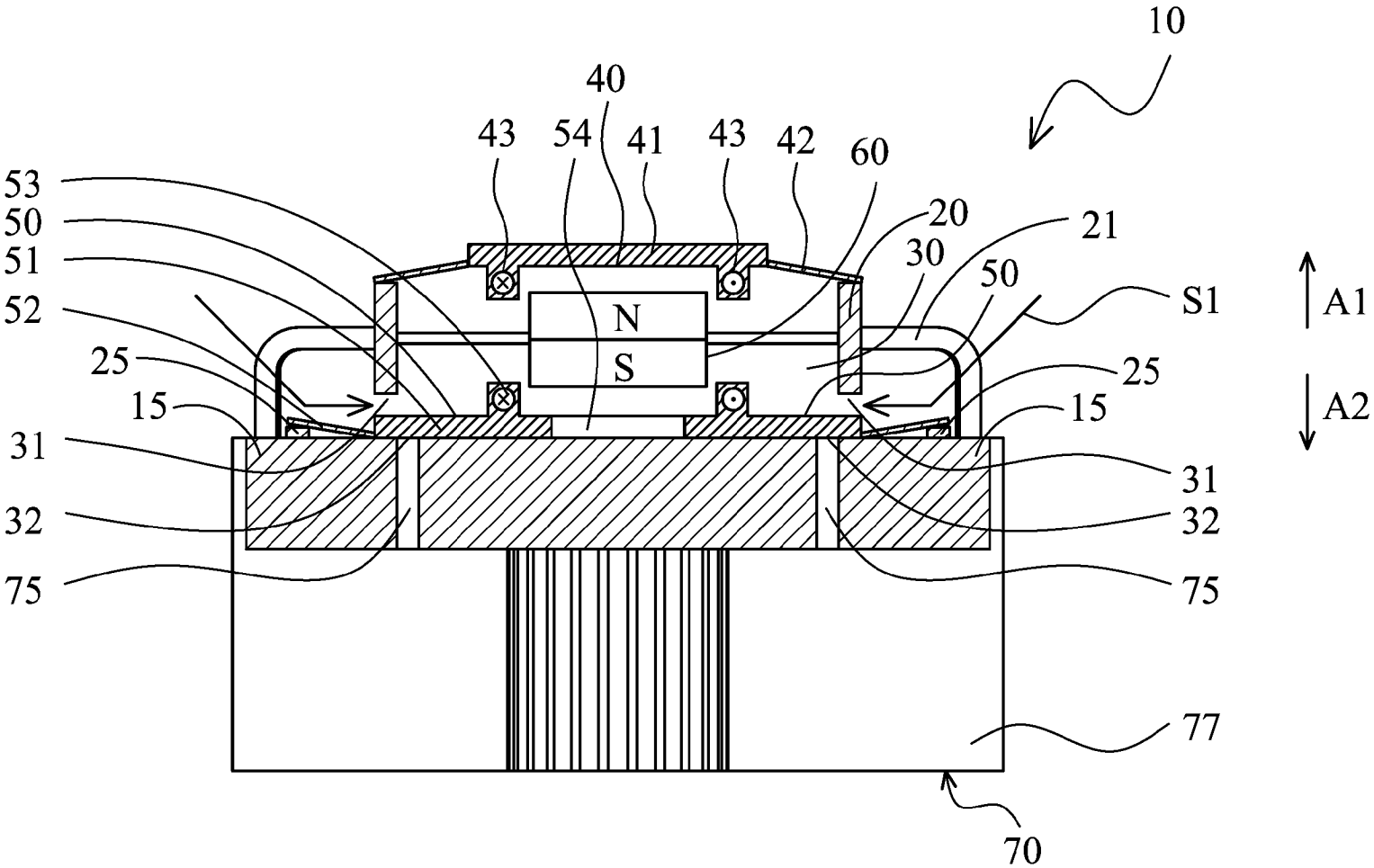
FIG. 3 is a sectional view showing of a synthetic jet equipment in an inspiratory state according to an embodiment of the disclosure.

Similarly, when the current direction applied to the second coil 53 is as shown in FIG. 3, the second coil 53 and the magnetic unit 60 generate a repulsion force (second magnetic force) therebetween, such that the valve diaphragm 52 and the second member 51 move in a second direction A2. When the second member 51 moves in the second direction A2, the outlet 32 of the base 15 can be closed. When the first member 41 moves in the first direction A1, and the second member 51 moves in the second direction A2, air can be drawn into the chamber 30 through the intake 31, such that the synthetic jet equipment 10 is in an inspiratory state.

Figure 4:
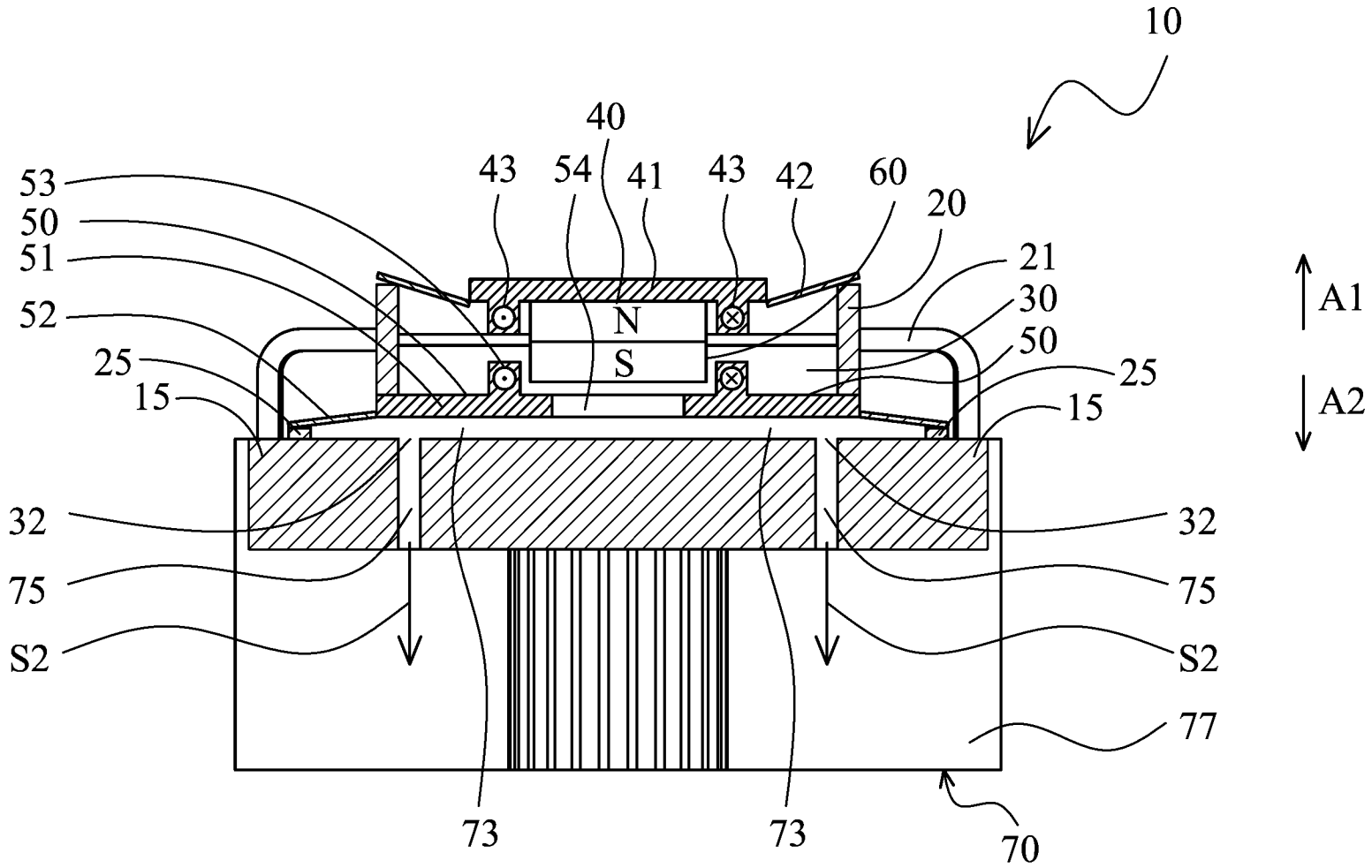
FIG. 4 is a sectional view showing of a synthetic jet equipment in an aspiratory state according to an embodiment of the disclosure.

As shown in FIG. 4, when the phase of the alternative current changes, the current directions of the first coil 43 and the second coil 53 are reversed, and the first coil 43 and the magnetic unit 60 may have an attraction force (third magnetic force) therebetween. Thus, the pump diaphragm 42 and the first member 41 may move in the second direction A2. Similarly, when the current direction of the second coil 53 reverses as shown in FIG. 4, the second coil 53 and the magnetic unit 60 produce an attraction force (fourth magnetic force) therebetween, and the valve diaphragm 52 and the second member 51 move in the first direction A1.

When the pump diaphragm 42 and the first member 41 move in the second direction A2, the chamber 30 is compressed, and air in the chamber 30 is ejected through the through hole 54 of the center of the second member 51, the first flow channel 73, and the outlet 32, so as to form a synthetic jet. The synthetic jet may be guided through a second flow channel 75 in the base 15 to the heat exchanger 70 for heat exchange, as the arrow S2 indicates in FIG. 4, wherein the second flow channel 75 extends through the base 15.

As shown in FIG. 4, when the second member 51 moves in the first direction A1, the intake 31 is closed, such that air in the chamber 30 is ejected through the through hole 54 of a center of the second member 51, a first flow channel 73, the outlet 32, and the second flow channel 75, and the synthetic jet equipment 10 is in an aspiratory state. In other words, when the first member 41 and the second member 51 move in the second direction A2 and the first direction A1 respectively, air in the chamber 30 can be ejected to produce the synthetic jet without external air flowing into the chamber 30.

Figure 6:
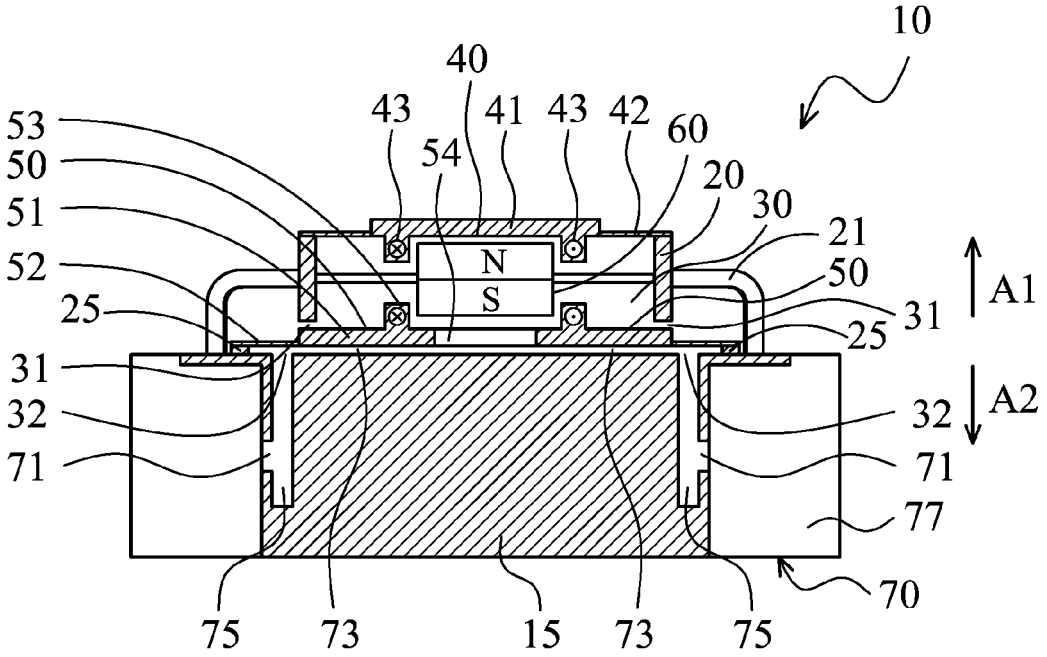
FIG. 6 is a sectional view of a synthetic jet equipment according to another embodiment of the disclosure.

Referring to FIG. 5 and FIG. 6, another embodiment of the disclosure provides a synthetic jet equipment 10 similar to the aforesaid embodiments (FIGS. 1-3). The differences between the present embodiment from the FIGS. 1-3 is that the base 15 of FIGS. 5 and 6 has the same height with the heat exchanger 70, wherein the base 15 and the heat exchanger 70 can be integrally formed in one piece. In FIG. 6, the second flow channel 75 is disposed in the base 15, and a nozzle 71 is formed on a side of the second flow channel 75. The synthetic jet from the outlet 32 can be horizontally ejected and guided through the second flow channel 75 and the nozzle 71 to dissipate heat via the fins 77 surrounding the heat exchanger 70. As shown in FIG. 5 and FIG. 6, the fins 77 are radically arranged surround and under the base 15 and separated from each other by the same distance. Here, the second flow channel 75 is not extended through the base 15.

In this embodiment, the first member 41, the first coil 43, the pump diaphragm 42, the second member 51, the second coil 53, the valve diaphragm 52, and the magnetic unit 60 have the same mechanism as FIGS. 1-3. In some embodiments, an alternating current with a frequency may be applied to the first coil 43 and the second coil 53, such that the pump diaphragm 42, the valve diaphragm 52, the first member 41, and the second member 51 can periodically vibrate. Furthermore, the first coil 43 and the second coil 53 may be respectively connected to an independently driven circuit to control the motions of the first member 41 and the second member 51.

Figure 7:
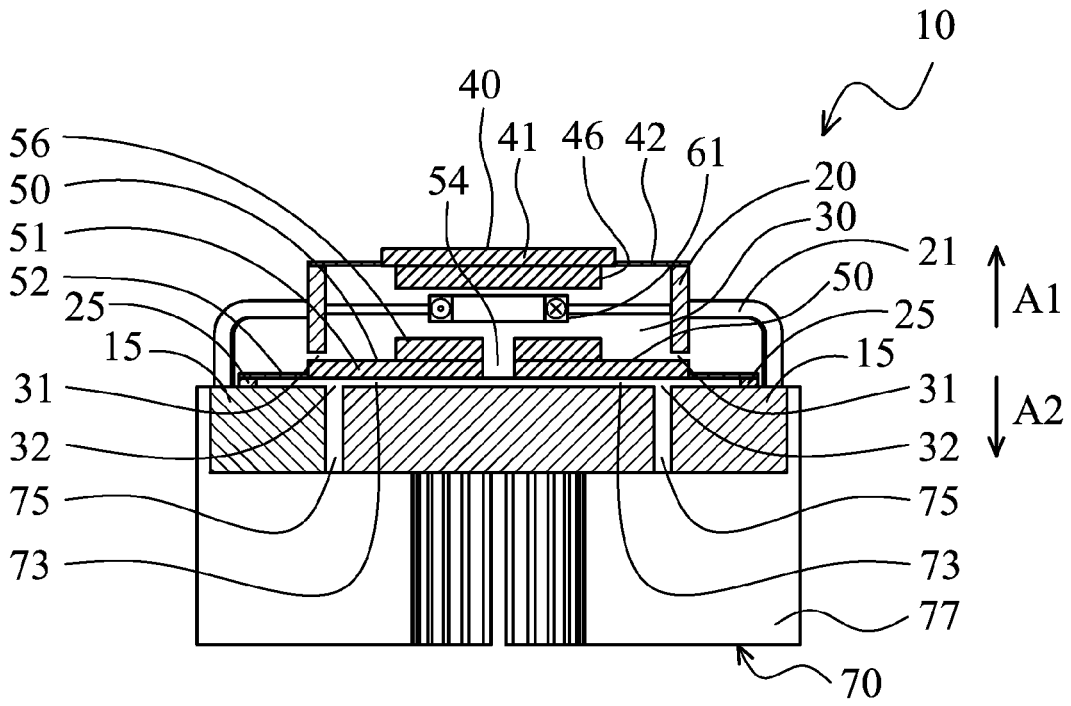
FIG. 7 is a sectional view of a synthetic jet equipment according to another embodiment of the disclosure.

Referring to FIG. 7, in another embodiment of the synthetic jet equipment 10, a first magnet 46 and a second magnet 56 are respectively fixed to the first member 41 and the second member 51, and a coil unit 61 is fixed to the holder 21, wherein the coil unit 61 is disposed between the first magnet 46 and the second magnet 56. When an alternating current is applied to the coil unit 61, the current induces an magnetic field influencing the first magnet 46 and the second magnet 56 by an attractive force or repulsive force, to drive the first magnet 46 and the second magnet 56 moving upward (first direction A1) or downward (second direction A2). Thus, the pump diaphragm 42, the valve diaphragm 52, the first member 41, and the second member 51 can produce periodic vibrations to generate a synthetic jet.

The disclosure provides a synthetic jet equipment having an intake and an outlet, preventing external air from drawing back into the chamber after heat exchange. Compared to the conventional synthetic jet actuator, the disclosure can always eject cold air and improve the efficiency of heat exchange.

While the disclosure has been described by way of example and in terms of the preferred embodiments, it is to be understood that the disclosure is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A synthetic jet equipment, comprising:

a base;

a frame, disposed upon the base;

a first member;

a pump diaphragm, connecting the first member to the frame;

a second member, disposed between the base and the frame;

a valve diaphragm, connecting the second member to the base and vibrating corresponding to a vibration of the pump diaphragm, wherein the base, the frame, the first member, the second member, the pump diaphragm, and the valve diaphragm form a chamber, and the chamber includes an intake and an outlet, wherein when the first member moves in a first direction, the second member moves in a second direction and blocks the outlet, and air flows into the chamber through the intake, and wherein the first direction is opposite to the second direction, wherein when the first member moves in the second direction, the second member moves in the first direction to block the intake, and the air is ejected from the outlet.

2. The synthetic jet equipment as claimed in claim 1, wherein the intake is formed between the second member and the frame, and the outlet is formed on the base.

3. The synthetic jet equipment as claimed in claim 1, wherein the synthetic jet equipment further comprises a heat exchanger, and the heat exchanger connects to the base and forms a plurality of fins.

4. The synthetic jet equipment as claimed in claim 1, wherein the pump diaphragm surrounds the first member, and the valve diaphragm surrounds the second member, and the second member has a through hole, and the air flows into the chamber through the intake and flows out sequentially through the through hole and the outlet.

5. The synthetic jet equipment as claimed in claim 1, wherein the synthetic jet equipment further comprises a magnetic unit, a first coil, and a second coil, and the magnetic unit is fixed to the frame and disposed between the first member and the second member, and the first coil and the second coil are respectively disposed on the first member and the second member and surround the magnetic unit.

6. The synthetic jet equipment as claimed in claim 5, wherein the synthetic jet equipment further comprises a holder, and the holder is fixed to the base and connected to the frame and the magnetic unit for fixing the magnetic unit in the frame.

7. The synthetic jet equipment as claimed in claim 5, wherein the magnetic unit comprises a permanent magnet.

8. The synthetic jet equipment as claimed in claim 5, wherein an alternating current is applied to the first coil and the second coil to produce periodic vibrations of the pump diaphragm, the valve diaphragm, the first member, and the second member.

9. The synthetic jet equipment as claimed in claim 8, wherein when a first magnetic force is applied to the first coil, the pump diaphragm and the first member move in the first direction, and when a second magnetic force is applied to the second coil, the valve diaphragm and the second member move in the second direction.

10. The synthetic jet equipment as claimed in claim 9, wherein when a third magnetic force is applied to the first coil, the pump diaphragm and the first member move in the second direction, and when the a fourth magnetic force is applied to the second coil, the valve diaphragm and the second member move in the first direction.

11. The synthetic jet equipment as claimed in claim 1, wherein the synthetic jet equipment further comprises a coil unit, a first magnet, and a second magnet, and the first magnet and the second magnet are respectively disposed on the first member and the second member, and the coil unit is fixed to the frame and disposed between the first magnet and the second magnet.

12. The synthetic jet equipment as claimed in claim 11, wherein the synthetic jet equipment further comprises a holder, fixed to the base and connected to the frame and the coil unit, to hold the coil unit in the frame.

13. The synthetic jet equipment as claimed in claim 11, wherein an alternating current is applied to the coil unit to produce periodic vibrations of the pump diaphragm, the valve diaphragm, the first member, and the second member.

* * * * *